US009472110B2

(12) United States Patent
Murthy et al.

(10) Patent No.: US 9,472,110 B2
(45) Date of Patent: Oct. 18, 2016

(54) AIRCRAFT TAXI PATH GUIDANCE AND DISPLAY

(71) Applicant: HONEYWELL INTERNATIONAL INC., Morristown, NJ (US)

(72) Inventors: Muthukumar Murthy, Tamilnadu (IN); Alpana Priyamvada, Karnataka (IN); Rocco DiVito, Etobicoke (CA)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 150 days.

(21) Appl. No.: 14/095,037

(22) Filed: Dec. 3, 2013

(65) Prior Publication Data

US 2015/0154874 A1 Jun. 4, 2015

(51) Int. Cl.
*G08G 5/06* (2006.01)
*G08G 5/00* (2006.01)

(52) U.S. Cl.
CPC ..... *G08G 5/06* (2013.01); *G08G 5/0021* (2013.01); *G08G 5/065* (2013.01)

(58) Field of Classification Search
CPC .. G01C 23/00; G01C 23/005; G08G 5/0004; G08G 5/0013; G08G 5/0017; G08G 5/0021; G08G 5/0026; G08G 5/0043; G08G 5/06; G08G 5/065
USPC ..... 701/3, 5, 9, 14, 15, 16, 528
See application file for complete search history.

(56) References Cited

U.S. PATENT DOCUMENTS 3,662,977 A 5/1972 Shannon
5,689,273 A 11/1997 Bailey et al.
6,571,166 B1 * 5/2003 Johnson ..... G08G 5/065 340/972
6,751,545 B2 6/2004 Walter
6,928,363 B2 8/2005 Sankrithi
6,947,742 B1 9/2005 Corrigan
7,342,514 B1 * 3/2008 Bailey ..... G01C 23/005 340/961
7,382,284 B1 * 6/2008 Armstrong ..... G08G 5/0021 340/958
7,382,288 B1 * 6/2008 Wilson ..... G01C 23/00 340/961
7,436,323 B2 10/2008 Ishihara et al.

(Continued)

FOREIGN PATENT DOCUMENTS

EP 1842772 A1 5/2009
EP 2211324 A1 7/2010
EP 2610590 A2 7/2013

OTHER PUBLICATIONS

EP Extended Search Report for EP 14192173.4-1803 dated Apr. 15, 2015.

(Continued)

*Primary Examiner* — Stephen Holwerda
(74) *Attorney, Agent, or Firm* — Lorenz & Kopf, LLP

(57) ABSTRACT

An aircraft taxi path guidance and display system is provided. The aircraft taxi path guidance and display system includes or cooperates with at least one source of aircraft status data, and a source of airport feature data associated with an airport field. The aircraft taxi path guidance and display system includes a processor operationally coupled to the source of aircraft status data and to the source of airport feature data. In response to aircraft status data and airport feature data, the processor predicts undesired deviations from an active surface area (e.g., an excursion). The processor generates corrective action associated with the excursion, and displays symbology that is graphically representative of the corrective action.

16 Claims, 8 Drawing Sheets

(56) References Cited

U.S. PATENT DOCUMENTS

| | | | | |
|---|---|---|---|---|
| 7,630,829 | B2 | 12/2009 | Pepitone | |
| 8,433,459 | B2 | 4/2013 | Michel et al. | |
| 2003/0102987 | A1* | 6/2003 | Walter | G01C 23/005 340/972 |
| 2007/0168111 | A1 | 7/2007 | Dubourg | |
| 2007/0240056 | A1* | 10/2007 | Pepitone | G05D 1/0083 715/705 |
| 2007/0241936 | A1* | 10/2007 | Arthur | G01C 23/00 340/958 |
| 2010/0191450 | A1 | 7/2010 | Ravenscroft et al. | |
| 2011/0046868 | A1 | 2/2011 | Michel et al. | |
| 2011/0257873 | A1* | 10/2011 | Lussiez | G06K 9/00791 701/120 |
| 2012/0046834 | A1* | 2/2012 | Lemay | G05D 1/0083 701/41 |

OTHER PUBLICATIONS

EP Examination Report for EP 14192173.3-1803 dated Jun. 5, 2016.

* cited by examiner

AIRCRAFT TAXI PATH GUIDANCE AND DISPLAY

TECHNICAL FIELD

Embodiments of the subject matter described herein relate generally to avionics guidance and display systems. More specifically, embodiments of the subject matter relate to aircraft taxi path guidance and display systems that display corrective action alerts when a deviation from an airport active surface area is predicted.

BACKGROUND

In its simplest form, an aircraft may be guided along a taxi path by a crew member manually steering the aircraft using a flight deck controller (e.g. a tiller) while looking out a window. In this case, the crew member utilizes their best judgment regarding how to guide the aircraft along an acceptable taxi path. Various visual guidance systems have been utilized to improve upon manual steering. Visual guidance systems generally determine a taxi path based on supplied inputs such as air traffic control (ATC) clearance, and present instructions for guiding the aircraft along the suggested taxi path; e.g. speed, steering, when to turn thrust engines off and when to turn electric drive motors on, etc. ATC clearance input can include taxi route, assigned take-off or landing runway, hold points, etc.

An aircraft may be powered during the taxi by a traditional taxi system or by an electric taxi system (ETS). Traditional aircraft taxi systems utilize the primary thrust engines (running at idle speed) and the braking system of the aircraft to regulate the speed of the aircraft during taxi. The electric taxi system (ETS) is an efficient upgrade to the traditional taxi system for aircraft. Electric taxi systems have traction drive systems that employ electric motors that can be powered by an auxiliary power unit (APU), rather than the primary thrust engines. Aircraft equipped with ETS have the ability to autonomously push back from the terminal, and are therefore not reliant upon the conventionally used push-back tractors, or tugs. Further, the ETS can provide most of the basic functions of tugs, and can serve as the main engine for taxiing The ETS also provides expanded turning capability. Traditional steering is performed by the aircraft nose wheel, and the radius of turn achieved is affected by aircraft size and wing length (generally approximately 60 degrees). In contrast, the ETS can control the main landing gear (MLG) relative speed between left and right wheels, resulting in sharper turns than what can be achieved by traditional steering (approximately 60-90 degrees). The ETS supported turns are referred to as "tight turns" or tight turn operations. All of the aforementioned advantages provided by ETS are autonomous.

During various aircraft ground operations such as a taxi, a tight turn, or a reverse operation, a deviation from an airport active surface area may occur. Traditionally, tools such as moving maps on Heads Down Displays, Heads Up Displays, Surface Guidance Systems, Enhanced Vision Systems, and the like, have been utilized to minimize the likelihood of occurrence of such a deviation. However, what is lacking is a tool to display an alert, such as an audible alert, a warning text, or a graphical representation of corrective action, when a deviation from the airport active surface area is predicted.

Accordingly, an aircraft taxi path guidance and display system that graphically displays an alert and corrective action when a deviation from the airport active surface area is predicted is desirable. It is desirable for the system to also display the alerts and corrective action for tight turn and reverse operations. Such an aircraft taxi path guidance and display system would increase situational awareness by proactively alerting the crew to avert predicted deviations.

Other desirable features will become apparent from the following detailed description and the appended claims, taken in conjunction with the accompanying drawings and this background.

BRIEF SUMMARY

A method for displaying aircraft taxi path guidance is provided. The method comprises obtaining aircraft status data for the aircraft and obtaining airport feature data associated with an airport field. In response to at least the aircraft status data and airport feature data, corrective action associated with an excursion is generated, wherein an excursion is a deviation from an airport active surface area. Symbology that is graphically representative of the corrective action is displayed.

Also provided is a method for displaying aircraft taxi path guidance. The method comprises obtaining aircraft status data and airport feature data. In response to at least the aircraft status data and airport feature data, the method determines an aircraft position relative to a centerline of an active surface area. Based on at least the aircraft position, the method generates corrective action associated with an excursion. Symbology that is graphically representative of the corrective action is displayed. Additionally, symbology that is graphically representative of the predicted aircraft taxi path is displayed.

A system for displaying taxi path guidance is also provided. The system includes a first source of aircraft status data, a second source of airport feature data, a display unit, and a processor operationally coupled to the first source, the second sources and the display unit. The processor is configured to receive the aircraft status data and the airport feature data. In response to at least the aircraft status data and airport feature data, the processor is configured to determine an aircraft position with respect to an active surface area. Based, at least in part on the aircraft position, the processor generates corrective action associated with an excursion. The processor further generates symbology that is graphically representative of the corrective action on the display unit.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF THE DRAWINGS

A more complete understanding of the subject matter may be derived by referring to the detailed description and claims when considered in conjunction with the following figures, wherein like reference numbers refer to similar elements throughout the figures and wherein:

DETAILED DESCRIPTION

Figure 1:
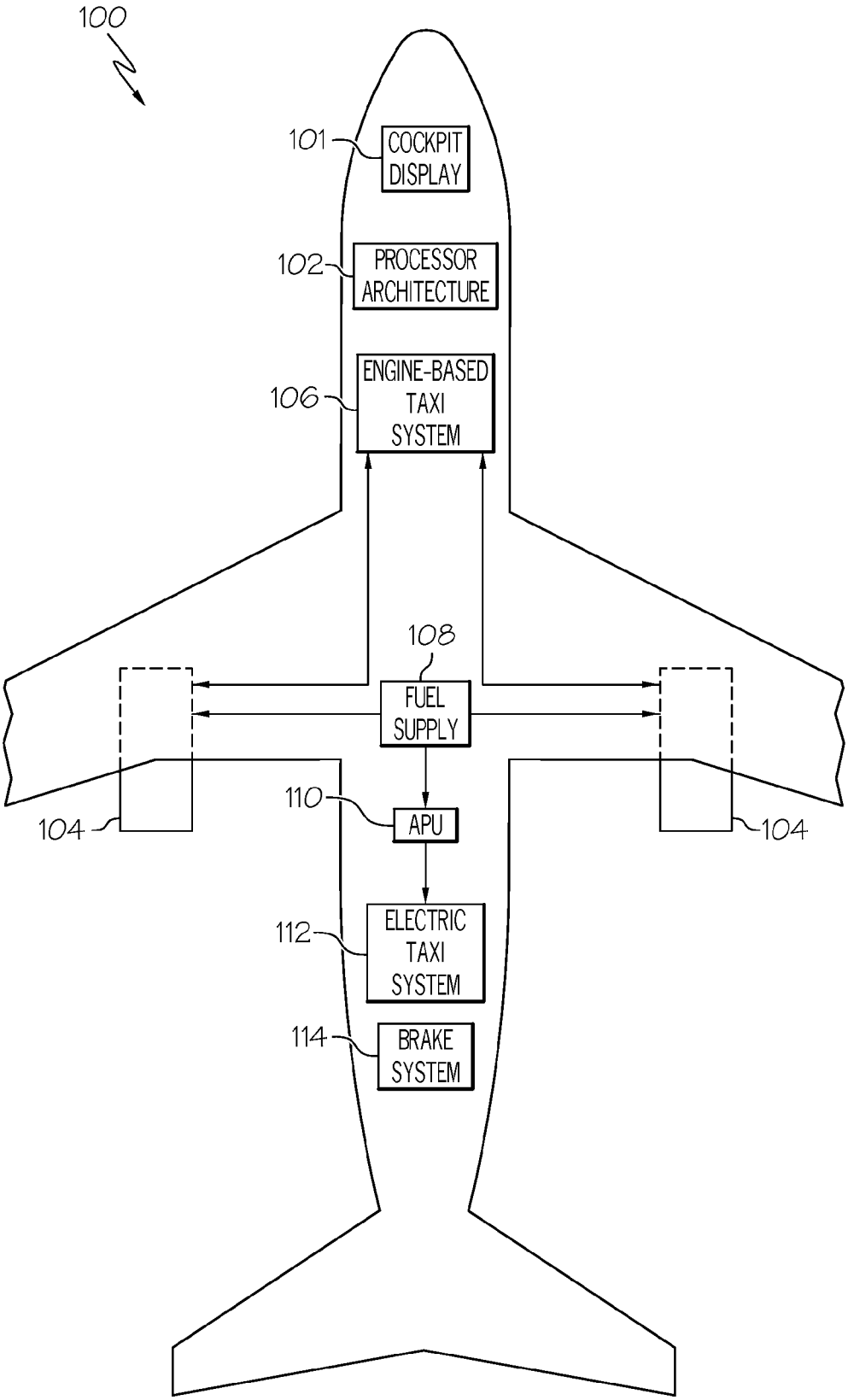
FIG. 1 is a simplified schematic representation of an aircraft having an aircraft taxi path display system.

The following detailed description is merely illustrative in nature and is not intended to limit the embodiments of the subject matter or the application and uses of such embodiments. As used herein, the word "exemplary" means "serving as an example, instance, or illustration." Any implementation described herein as exemplary is not necessarily to be construed as preferred or advantageous over other implementations. Furthermore, there is no intention to be bound by any expressed or implied theory presented in the preceding technical field, background, brief summary, or the following detailed description.

Techniques and technologies may be described herein in terms of functional and/or logical block components and with reference to symbolic representations of operations, processing tasks, and functions that may be performed by various computing components or devices. Such operations, tasks, and functions are sometimes referred to as being computer-executed, computerized, software-implemented, or computer-implemented. It should be appreciated that the various block components shown in the figures may be realized by any number of hardware, software, and/or firmware components configured to perform the specified functions. For example, an embodiment of a system or components may employ various integrated circuit components (e.g. memory elements, digital signal processing elements, logic elements, look-up tables, or the like) that may carry out a variety of functions under the control of one or more microprocessors or other control devices.

The system and methods described herein can be deployed with any vehicle that may be subjected to taxi operations, such as aircraft. Aircraft taxi operations are sometimes referred to as an aircraft rolling phase or ground traffic flow. The exemplary embodiment described herein assumes that the aircraft includes an electric taxi system (ETS), which utilizes one or more electric motors as a traction system to drive the wheels of the aircraft during taxi operations. The ETS is capable of controlling the aircraft on all aircraft taxi operations. The surface area within the airport in which the aircraft may safely travel is referred to as airport active surface area, and includes, but is not limited to, runway paths and taxi paths. Any inappropriate exit or deviation from the airport active surface area is referred to as an excursion. An excursion may occur during various aircraft maneuvers (e.g., a taxi operation, a tight turn, or a reverse operation).

The system and methods presented herein display a warning with corrective action in response to a predicted excursion. The warning alerts the aircraft crew via a display of corrective action. The corrective action may then be utilized to optimize and otherwise enhance safety during taxi operations. The corrective action may be based on one or more factors such as, without limitation: aircraft position, aircraft speed, aircraft turning radius, aircraft wing width, and the differential speed of the main landing gear. In certain embodiments, the corrective action is rendered with a graphical display of the airport field to provide visual guidance. In various embodiments, the graphical representation of the corrective action may include an alert in the form of symbols and/or text. The corrective action may be displayed using database assembled images such as 2D-Airport Moving Map, Synthetic Vision system, Surface Guidance System, Enhanced Guidance System, or the like. The display system may be implemented as an onboard flight deck system, as a portable computer, as an electronic flight bag, or any combination thereof. The Runway Awareness and Advisory System (RAAS) may be utilized to provide supplemental information on position of the aircraft relative to the runway. Some embodiments include corrective action guidance in the form of audible warnings.

FIG. 1 is a simplified schematic representation of an aircraft (AC) 100. For the sake of clarity and brevity, FIG. 1 does not depict the vast number of systems and subsystems that would appear onboard a practical implementation of the aircraft 100. Instead, FIG. 1 merely depicts some of the notable functional elements and components of the aircraft 100 that support the various features, functions, and operations described in more detail below. In this regard, the aircraft 100 may include, without limitation: a cockpit display 101, a processor architecture 102; at least two primary thrust engines 104; an engine-based taxi system 106; a fuel supply 108; an auxiliary power unit (APU) 110; an electric taxi system 112; and a brake system 114. These elements, components, and systems may be coupled together as needed to support their cooperative functionality.

The processor architecture 102 may be implemented or realized with at least one general purpose processor, a content addressable memory, a digital signal processor, an application specific integrated circuit, a field programmable gate array, any suitable programmable logic device, discrete gate or transistor logic, discrete hardware components, or any combination designed to perform the functions described herein. A processor device may be realized as a microprocessor, a controller, a microcontroller, or a state machine. Moreover, a processor device may be implemented as a combination of computing devices, e.g., a combination of a digital signal processor and a microprocessor, a plurality of microprocessors, one or more microprocessors in conjunction with a digital signal processor core, or any other such configuration. As described in more detail below, the processor architecture 102 is configured to support various electric taxi path guidance processes, operations, and display functions.

In practice, the processor architecture 102 may be realized as an onboard component of the aircraft 100 (e.g., a flight deck control system, a flight management system, or the like), or it may be realized in a portable computing device that is carried onboard the aircraft 100. For example, the processor architecture 102 could be realized as the central processing unit (CPU) of a laptop computer, a tablet computer, or a handheld device. As another example, the processor architecture 102 could be implemented as the CPU of an electronic flight bag carried by a member of the flight crew or mounted permanently in the aircraft. Electronic flight bags and their operation are explained in documentation available from the United States Federal Aviation Administration (FAA), such as FAA document AC 120-76A.

The processor architecture 102 may include or cooperate with an appropriate amount of memory (not shown), which can be realized as RAM memory, flash memory, EPROM memory, EEPROM memory, registers, a hard disk, a removable disk, a CD-ROM, or any other form of storage medium known in the art. In this regard, the memory can be coupled to the processor architecture 102 such that the processor architecture 102 can read information from, and write information to, the memory. In the alternative, the memory may be integral to the processor architecture 102. In practice, a functional or logical module/component of the system described here might be realized using program code that is maintained in the memory. Moreover, the memory can be used to store data utilized to support the operation of the system, as will become apparent from the following description.

The illustrated embodiment of the aircraft includes at least two primary thrust engines 104, which may be fed by the fuel supply 108. The engines 104 serve as the primary sources of thrust during flight. The engines 104 may also function to provide a relatively low amount of thrust (e.g., at idle) to support a conventional engine-based taxi system 106. When running at idle, the engines 104 typically provide a fixed amount of thrust to propel the aircraft 100 for taxi maneuvers. When the engines 104 are utilized for taxi operations, the speed of the aircraft is regulated by the brake system 114.

Exemplary embodiments of the aircraft 100 also include the electric taxi system 112 (which may be in addition to or in lieu of the engine-based taxi system 106 that typically provides a pilot with manual control of the aircraft). In certain implementations, the electric taxi system 112 includes at least one electric motor (not shown in FIG. 1) that serves as the traction system for the drive wheel assemblies (not shown in FIG. 1) of the aircraft 100. The electric motor may be powered by the APU 110 onboard the aircraft 100, which in turn is fed by the fuel supply 108. As described in more detail below, the electric taxi system 112 can be controlled by a member of the flight crew to achieve a desired taxi speed. Unlike the conventional engine-based taxi system 106, the electric taxi system 112 can be controlled to regulate the speed of the drive wheels without requiring constant or frequent actuation of the brake system 114. This advantage provided by ETS allows for tighter turning ratios. The aircraft 100 may employ any suitably configured electric taxi system 112, which employs electric motors to power the wheels of the aircraft during taxi operations.

Figure 2:
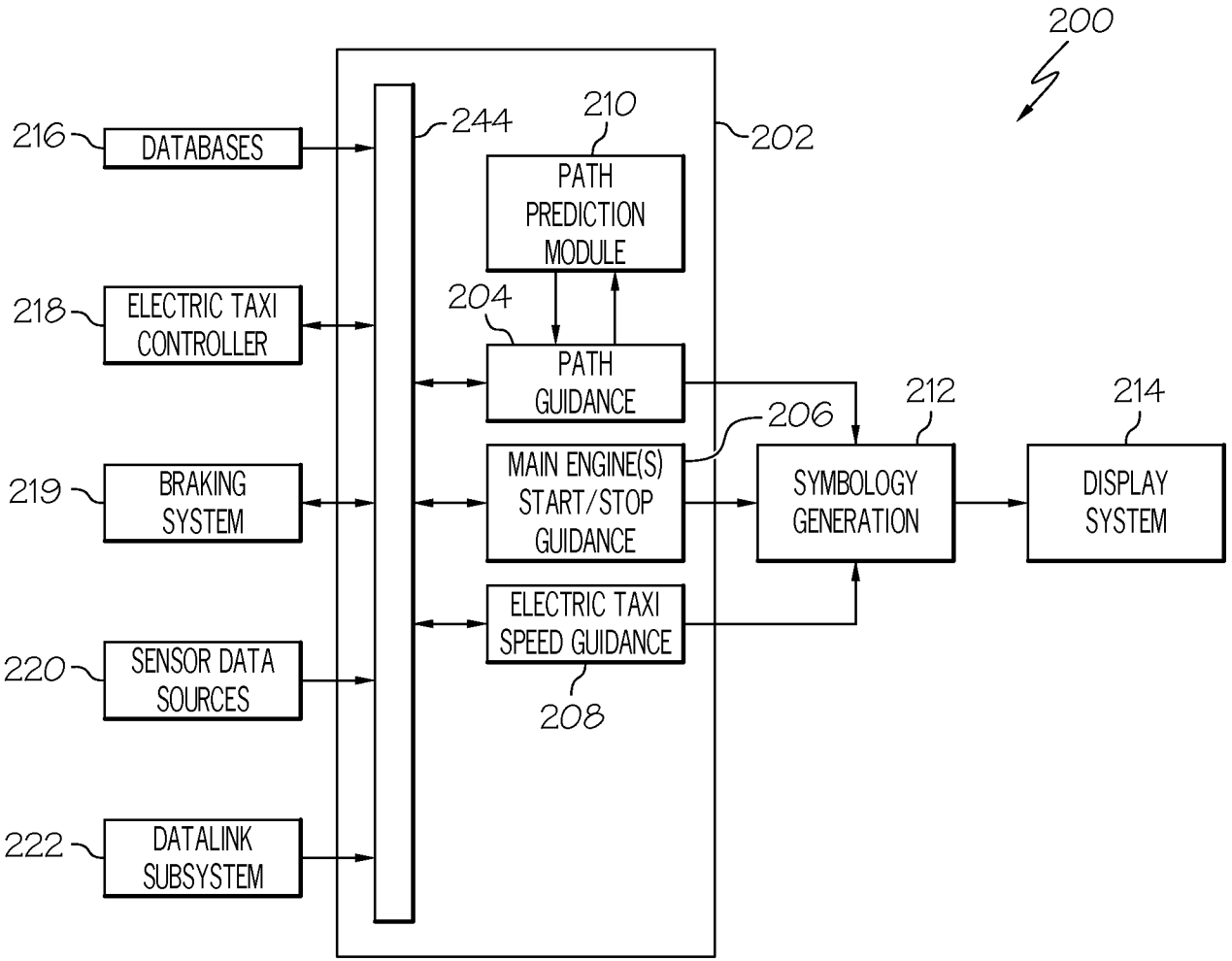
FIG. 2 is a block diagram of an exemplary embodiment of an aircraft taxi path guidance and display system suitable for use with an aircraft.

FIG. 2 is a schematic representation of an exemplary embodiment of a taxi path guidance and display system 200 suitable for use with the aircraft 100. Depending upon the particular embodiment, the taxi path guidance and display system 200 may be realized in conjunction with a ground management system 202, which in turn may be implemented in a line replaceable unit (LRU) for the aircraft 100, in an onboard subsystem such as the flight deck display system, in an electronic flight bag, in an integrated modular avionics (IMA) system, or the like. The illustrated embodiment of the taxi path guidance and display system 200 generally includes, without limitation: a path guidance module 204; an engine start/stop guidance module 206; an electric taxi speed guidance module 208; a path prediction module 210; a symbology generation module 212; and a display system 214. The taxi path guidance and display system 200 may also include or cooperate with one or more of the following elements, systems, components, or modules: databases 216; a controller 218 for the electric taxi system motor; braking system 219, and sensor data sources 220. In practice, various functional or logical modules of the taxi path guidance and display system 200 may be implemented with the processor architecture 102 (and associated memory) described above with reference to FIG. 1. The taxi path guidance and display system 200 may employ any appropriate communication architecture, such as datalink subsystem 222, or any arrangement that facilitates inter-function data communication, transmission of control and command signals, provision of operating power, transmission of sensor signals, etc.

The taxi path guidance and display system 200 is suitably configured such that the path guidance module 204, the engine start/stop guidance module 206, and/or the electric taxi speed guidance module 208 are responsive to or are otherwise influenced by a variety of inputs. For this particular embodiment, the influencing inputs are obtained from one or more of the sources and components listed above (i.e., the items depicted at the left side of FIG. 2). The outputs of the path guidance module 204, the engine start/stop guidance module 206, and/or the electric taxi speed guidance module 208 are provided to the symbology generation module 212, which generates corresponding graphical representations suitable for rendering with a graphical display of an airport field. The symbology generation module 212 cooperates with the display system 214 to present taxi path guidance information to the user.

The databases 216 represent sources of data and information that may be used to generate taxi path guidance information. For example the databases 216 may store any of the following, without limitation: airport location data; airport feature data, which may include layout data, coordinate data, data related to the location and orientation of gates, runways, taxiways, etc.; airport restriction or limitation data; aircraft configuration data; aircraft model information; engine cool down parameters, such as cool down time period; engine warm up parameters, such as warm up time period; electric taxi system specifications; and the like. In certain embodiments, the databases 216 store airport feature data that is associated with (or can be used to generate) database assembled images, such as a 2D-Airport Moving Map or synthetic graphical representations of a departure or destination airport field. The databases 216 may be updated as needed to reflect the specific aircraft, the current flight path, the departing and destination airports, and the like.

The controller 218 includes the control logic and hardware for the electric taxi motor. In this regard, the controller 218 may include one or more user interface elements that enable the pilot to activate, deactivate, and regulate the operation of the electric taxi system as needed. The controller 218 may also be configured to provide information related to the status of the electric taxi system, such as operating condition, wheel speed, motor speed, and the like.

The sensor data sources 220 represent various sensor elements, detectors, diagnostic components, and their associated subsystems onboard the aircraft. In this regard, the sensor data sources 220 function as sources of aircraft status data for the host aircraft. In practice, the taxi path guidance and display system 200 could consider any type or amount of aircraft status data including, without limitation, data indicative of: tire pressure; nose wheel angle; brake temperature; brake system status; outside temperature; ground temperature; engine thrust status; primary engine on/off status; aircraft ground speed; geographic position of the aircraft; wheel speed; electric taxi motor speed; electric taxi motor on/off status; or the like.

The datalink subsystem 222 is utilized to provide air traffic control data to the host aircraft, preferably in compliance with known standards and specifications. Using the datalink subsystem 222, the taxi path guidance and display system 200 can receive air traffic control data from ground based air traffic controller stations and equipment. In turn, the taxi path guidance and display system 200 can utilize such air traffic control data as needed. For example, taxi maneuver clearance and other airport navigation instructions may be provided by an air traffic controller using the datalink subsystem 222.

The path guidance module 204, the engine start/stop guidance module 206, and the electric taxi speed guidance module 208 are suitably configured to respond in a dynamic manner to provide real-time guidance for optimized operation of the electric taxi system. In practice, the taxi path guidance information (e.g., taxi path guidance information, start/stop guidance information for the engines, and speed guidance information for the electric taxi system) might be generated in accordance with a fuel conservation specification or guideline for the aircraft, in accordance with an operating life longevity specification or guideline for the brake system 114 (see FIG. 1), and/or in accordance with other optimization factors or parameters. The path guidance module 204 continually processes relevant input data and, in response thereto, generates taxi path guidance information related to a desired taxi route to follow. The desired taxi route can then be presented to the flight crew in an appropriate manner. The engine start/stop guidance module 206 processes relevant input data and, in response thereto, generates start/stop guidance information that is associated with operation of the primary thrust engine(s) and/or is associated with operation of the electric taxi system. As explained in more detail below, the start/stop guidance information may be presented to the user in the form of symbology or textual indicators in a graphical representation of the airport field. The electric taxi speed guidance module 208 processes relevant input data and, in response thereto, generates speed guidance information for the onboard electric taxi system. The speed guidance information may be presented to the user as a dynamic alphanumeric field displayed in the graphical representation of the airport field.

In the embodiments presented herein, the path guidance module 204 is coupled to and communicates with a path prediction module 210. The path prediction module 210 relies on input data such as, but not limited to, the required airport feature data and the status and sensor data associated with the current aircraft. Based in part on the input data, the path prediction module 210 calculates aircraft heading and generates a trend line that represents the aircraft predicted taxi path. Aircraft heading is based upon, inter alia, the nose wheel steering angle, and main landing differential steering commands. The path prediction module 210 monitors the taxi path trend line with respect to the centerline of the relevant active surface area of the airport. The path prediction module 210 determines the deviation between the taxi path trend line and the centerline. When the taxi path trend line indicates an impending intersection of the aircraft taxi path with a shoulder of a relevant active area, the distance threshold is checked. An intersection of the taxi path trend line and shoulder at or below the distance threshold is referred to as an excursion. The distance threshold is a predetermined distance based on one or more factors such as, but not limited to: aircraft length, wing width, width of active surface area, aircraft speed, and aircraft turning angle. When an excursion is predicted, the maximum steering capacity is checked, and a corresponding alert is generated. In response to the alert, the path guidance module 204 prompts the symbology generation module 212 to generate corrective action for display on the display system 214.

The symbology generation module 212 can be suitably configured to receive the output of the path guidance module 204, the engine start/stop guidance module 206, and the electric taxi speed guidance module 208, and to process the received information in an appropriate manner for incorporation, blending, and integration with the dynamic graphical representation of the airport field. Thus, the electric taxi path guidance information can be merged into the graphical display to provide enhanced situational awareness and taxi instructions to the pilot in real-time.

The exemplary embodiment described herein relies on graphically displayed and rendered taxi path guidance information. Accordingly, the display system 214 includes at least one display element. In an exemplary embodiment, the display element cooperates with a suitably configured graphics system (not shown), which may include the symbology generation module 212 as a component thereof. This allows the display system 214 to display, render, or otherwise convey one or more graphical representations, synthetic displays, graphical icons, visual symbology, or images associated with operation of the host aircraft on the display element, as described in greater detail below. In practice, the display element receives image rendering display commands from the display system 214 and, in response to those commands, renders a dynamic graphical representation of the airport field during taxi operations.

In an exemplary embodiment, the display element is realized as an electronic display configured to graphically display flight information or other data associated with operation of the host aircraft 100 under control of the display system 214. The display system 214 is usually located within a cockpit of the host aircraft 100. Alternatively (or additionally), the display system 214 could be realized in a portable computer, and electronic flight bag, or the like.

Although the exemplary embodiment described herein presents the taxi path guidance and display information in a graphical (displayed) manner, the guidance information could alternatively or additionally be annunciated in an audible manner. For example, in lieu of graphics, the system could provide audible steering instructions (e.g., steer left, steer right, etc.) and/or braking instructions. Alternatively, the system may utilize indicator lights or other types of feedback instead of a graphical display of the airport field.

Figure 3:
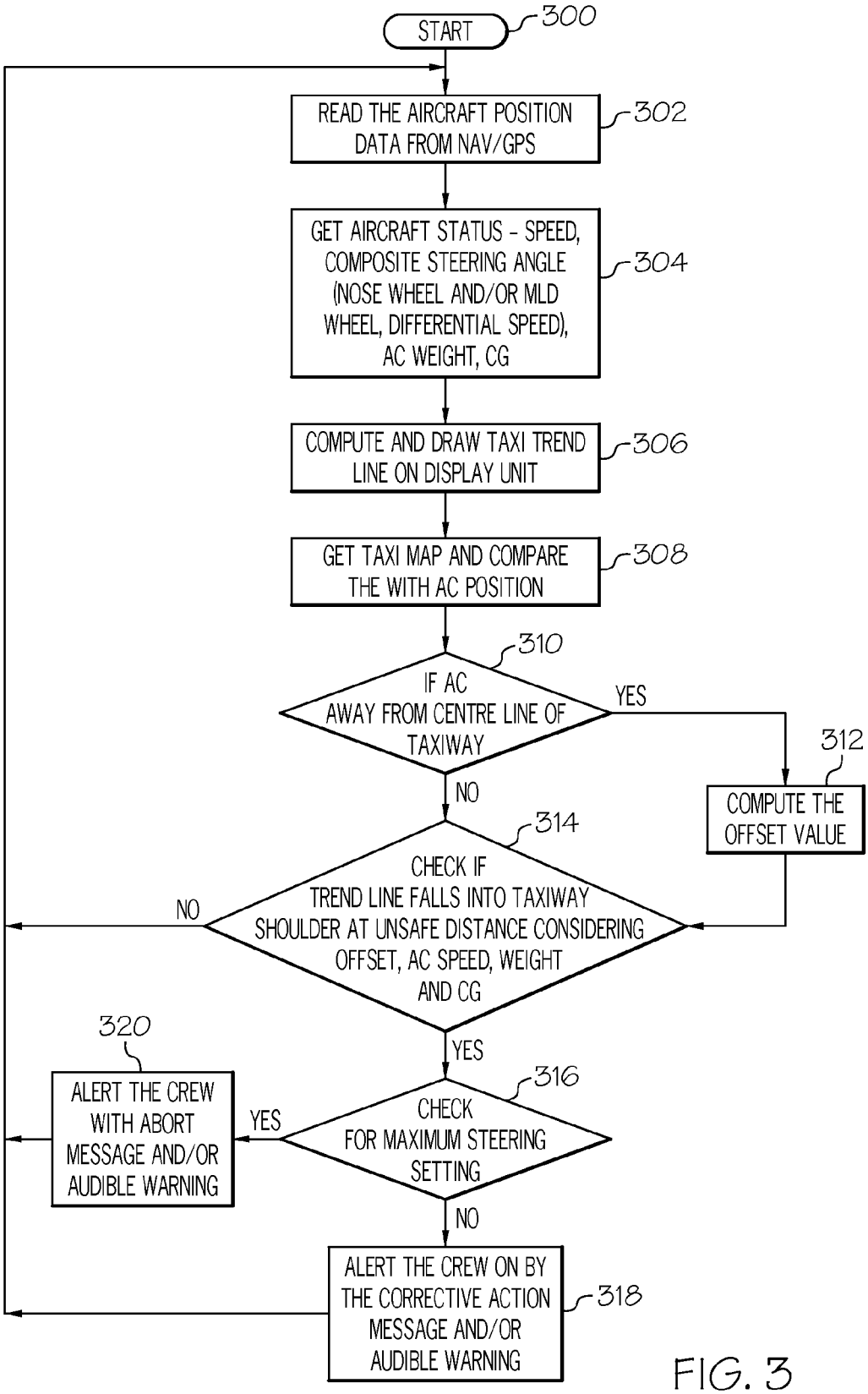
FIG. 3 is a flow chart that illustrates an exemplary embodiment of the prediction process utilized in the aircraft taxi path guidance and display process.

FIG. 3 is a flow chart that illustrates an exemplary embodiment of a prediction process 300, carried out by path prediction module 210 (FIG. 2). The process 300 may be performed by an appropriate system or component of the host aircraft 100, such as the taxi path guidance and display system 200. The various tasks performed in connection with the process 300 may be performed by software, hardware, firmware, or any combination thereof. For illustrative purposes, the following description of the process 300 may refer to elements mentioned above in connection with FIG. 1 and FIG. 2. In practice, portions of the process 300 may be performed by different elements of the described system, e.g., the processor architecture 102, the ground management system 202, the path guidance module 204, the symbology generation module 212, or the display system 214. It should be appreciated that the process 300 may include any number of additional or alternative steps, the steps shown in FIG. 3 need not be performed in the illustrated order, and process 300 may be incorporated into a more comprehensive procedure or process having additional functionality not described in detail herein. Moreover, one or more of the steps shown in FIG. 3 could be omitted from an embodiment of the process 300 as long as the intended overall functionality remains intact.

Process 300 is performed before the aircraft takes off or after it has landed. More specifically, the process 300 can be performed while the aircraft is in a ground operation, such as a taxi, and in a virtually continuous manner at a relatively high refresh rate.

The process 300 obtains, receives, accesses, or acquires certain data and information that influences the generation and presentation of taxi path guidance and display information. In this regard, the process may acquire input data from various data sources and databases. The input data may also include data received from air traffic control via the datalink subsystem 222. Referring again to FIG. 2, the various elements, systems, and components that feed the taxi path guidance and display system 200 may provide the input data for STEPS 302, 304 and 308.

In the exemplary embodiment, the prediction process 300 accesses or retrieves aircraft position data from a navigation or Global Positioning System (STEP 302). Status data for the host aircraft "AC" (such as heading data, steering angle, differential speed, weight, center of gravity "CG," etc.) and from data sources such as onboard sensors and detectors is retrieved (STEP 304). Based on the aircraft position and status data the process computes and displays a predicted aircraft taxi path trend line on a display unit (STEP 306).

Next, process 300 retrieves the airport feature data that is associated or otherwise indicative of graphical representations of the particular airport field. The airport feature data might be maintained onboard the aircraft, and the airport feature data corresponds to, represents, or is indicative of certain visible and displayable features of the airport field of interest. The airport feature data includes a taxi map with an identified active surface area for the airport taxi operation.

The taxi map is compared to the aircraft position (STEP 308). The aircraft position is compared to the center line of the identified active surface area (STEP 310), and any offset from the center line is computed (STEP 312). Next, the process checks whether the aircraft taxi path trend line indicates travel onto the shoulder of the identified active surface area at or below a distance threshold (STEP 314). The distance threshold in STEP 314 is based on factors such as, but not limited to, active surface dimensions, aircraft speed, size, wing width and weight. If the taxi path trend line indicates travel onto the shoulder within the distance threshold (STEP 314), the process next checks the aircraft maximum steering setting (STEP 316). If the aircraft's maximum steering setting has been reached, the process displays an alert with an abort message and/or audible warning (STEP 320). In the alternative, if steering is determined to be a viable corrective action, the process displays an alert recommending corrective action and/or an audible alert is generated (STEP 318). The process then returns to reading aircraft position data (STEP 302).

Although the corrective action could be conveyed, presented, or annunciated to the flight crew or pilot in different ways, the exemplary embodiment described herein displays graphical representations of the corrective action in addition to the taxi path guidance information, the engine start/stop guidance information, and the speed guidance information. More specifically, the process 300 renders corrective action information with a dynamic graphical display of the airport field. Audible warnings may be included. In this example, STEP 318 and STEP 320 render the corrective action within a graphical display of the airport field in accordance with variables such as the current geographic position data of the host aircraft, the current heading data of the host aircraft, and the airport feature data. As explained in more detail below, the graphical representation of the airport field might include graphical features corresponding to airport active surface areas such as taxiways, runways, taxiway/runway signage, the desired taxi path, and the like. The graphical display may also include graphical representations of an engine on/off indicator and a target electric taxi speed indicator, and various textual commands. In practice, the dynamic graphical display may also include a perspective view of terrain near or on the airport field. In certain embodiments, the image rendering display commands may also be used to control the rendering of additional graphical features, such as flight instrumentation symbology, flight data symbology, and the like.

The relatively high refresh rate of the process 300 results in a relatively seamless and immediate updating of the display. Thus, the process 300 is iteratively repeated to update the graphical representation of the airport field and its features, possibly along with the corrective action and other graphical elements of the synthetic display. Notably, the taxi path display information may also be updated in an ongoing manner to reflect changes to the operating conditions, traffic conditions, air traffic control instructions, and the like. In practice, the process 300 can be repeated indefinitely and at any practical rate to support continuous and dynamic updating and refreshing of the display in real-time or virtually real-time. Frequent updating of the displays enables the flight crew to obtain and respond to the current operating situation in virtually real-time, enhancing situational awareness.

Figure 4:
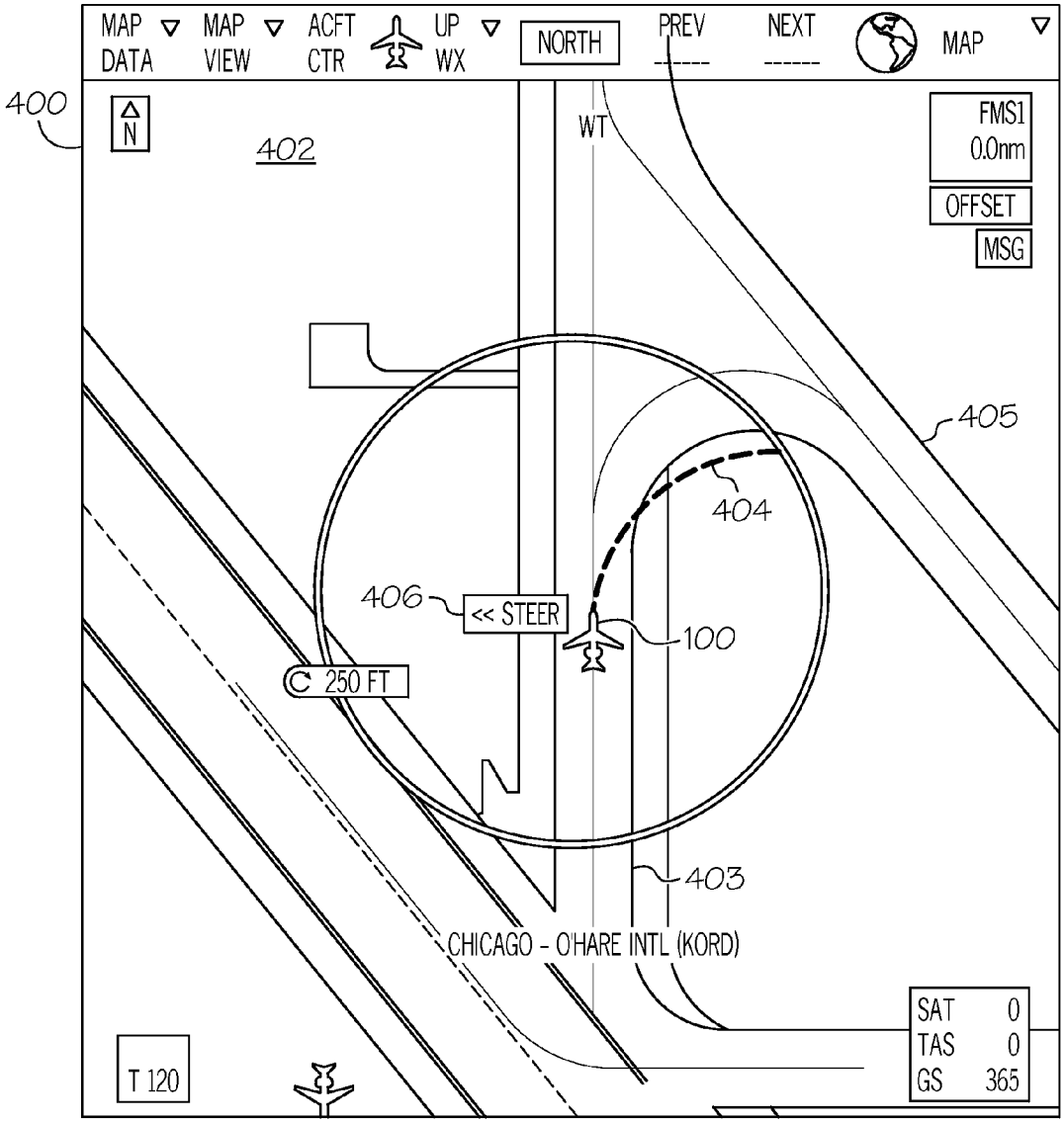
FIG. 4 is a graphical representation of a 2D-Airport Moving Map having rendered thereon an airport field, a predicted excursion, and corrective action.

FIG. 4 is a graphical representation of a top-down display 400 having rendered thereon a 2D-Airport Moving Map of an airport field 402 and aircraft 100. The display 400 includes a graphical representation of a taxi path 403, which corresponds to the taxiway on which the host aircraft 100 is currently traveling in a ground operation. Graphical representations of various other features, structures, fixtures, and/or elements associated with the airport field 402 are included in display 400; such as other taxiways 405, conformally rendered in accordance with their real-world counterpart taxiways. Display 400 also includes a trend line 404 depicting the predicted aircraft taxi path. Symbology indicative of corrective action to be taken is shown at 406.

FIG. 4 depicts a moment in time when the aircraft 100 is being driven by the electric taxi system, and trend line 404 shows the predicted aircraft path. In display 400, trend line 404 indicates a predicted excursion, in which aircraft 100 travels away from the centerline of the taxi path to the right, crosses onto the shoulder within an unsafe distance, and continues to travel off of taxi path 403 to the right. The guidance and display system may generate an audible alert in response to the predicted excursion. In response to the predicted excursion, the guidance and display system graphically displays an alert. The graphical display of the alert may comprise one or more symbolic representations, such as: the trend line 404 rendered in a visually distinguishable or highlighted manner that is easy to detect and recognize; text and symbols 406 conveying corrective action to avert the excursion, rendered in a visually distinguishable or highlighted manner; etc.

Figure 5:
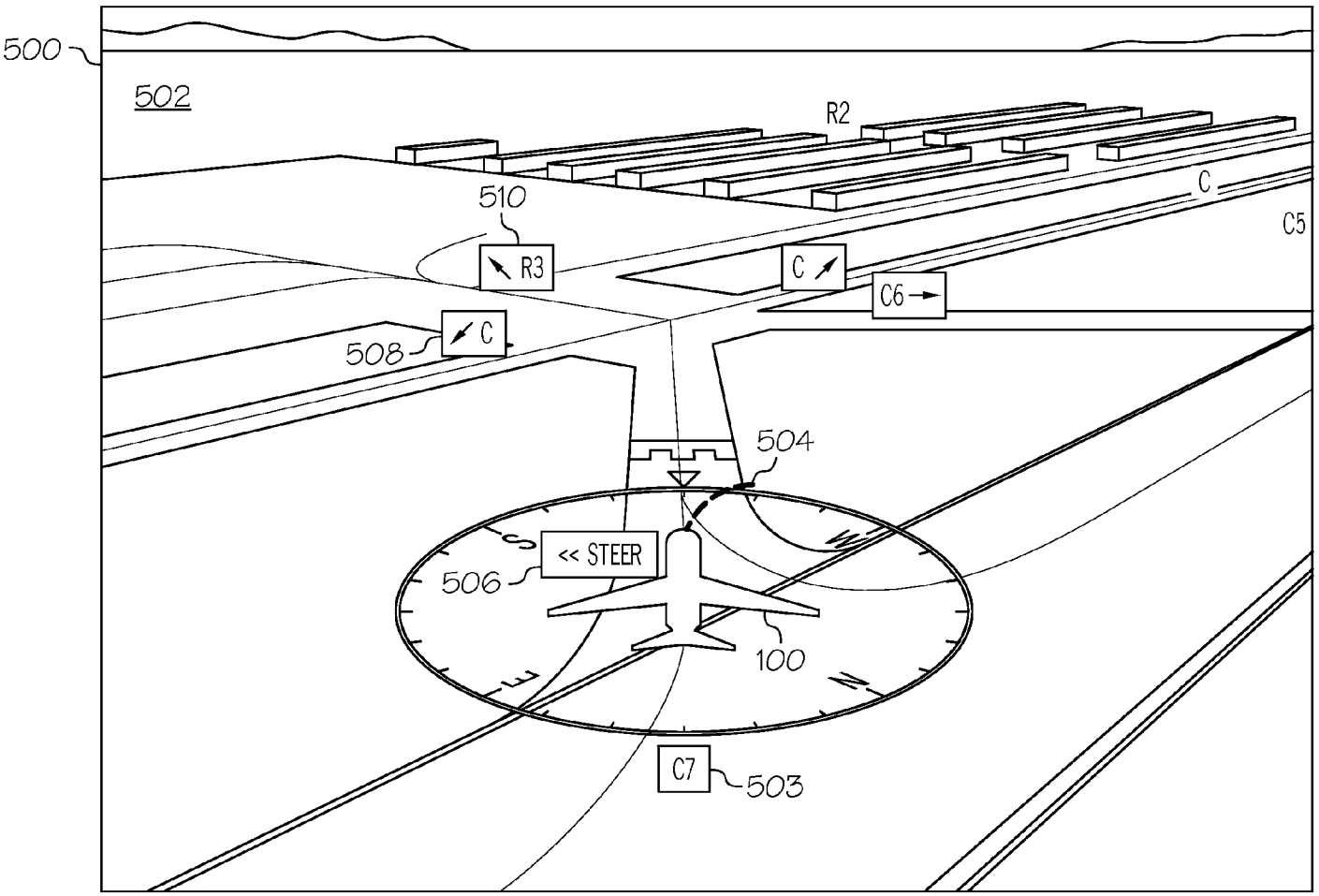
FIG. 5 is a graphical representation of a synthetic vision system display having rendered thereon an airport field, a predicted excursion, and corrective action.

FIG. 5 is a graphical representation of a display 500 having rendered thereon a synthetic vision system map of an airport field 502 and aircraft 100. The display 500 includes a graphical representation of a taxi path 503, which corresponds to the taxiway on which the host aircraft 100 is currently traveling in a ground operation. Graphical representations of various other features, structures, fixtures, and/or elements associated with the airport field 502 are included in display 500; such as other taxiways 508, 510, conformally rendered in accordance with their real-world counterpart taxiways. Display 500 also includes a trend line 504 depicting the predicted aircraft taxi path. Symbology indicative of corrective action to be taken is shown at 506.

FIG. 5 depicts a moment in time when the aircraft 100 is being driven by the electric taxi system, and trend line 504 shows the predicted aircraft path. In display 500, trend line 504 indicates a predicted excursion, in which aircraft 100 travels away from the centerline of the taxi path to the right, crosses onto the shoulder within an unsafe distance, and continues to travel off taxi path 503 to the right. The guidance and display system may generate an audible alert in response to the predicted excursion. In response to the predicted excursion, the guidance and display system graphically displays an alert. The graphical display of the alert may comprise one or more symbolic representations, such as: the trend line 504 rendered in a visually distinguishable or highlighted manner that is easy to detect and recognize; text and symbols 506 conveying corrective action to avert the excursion, rendered in a visually distinguishable or highlighted manner; etc.

Figure 6:
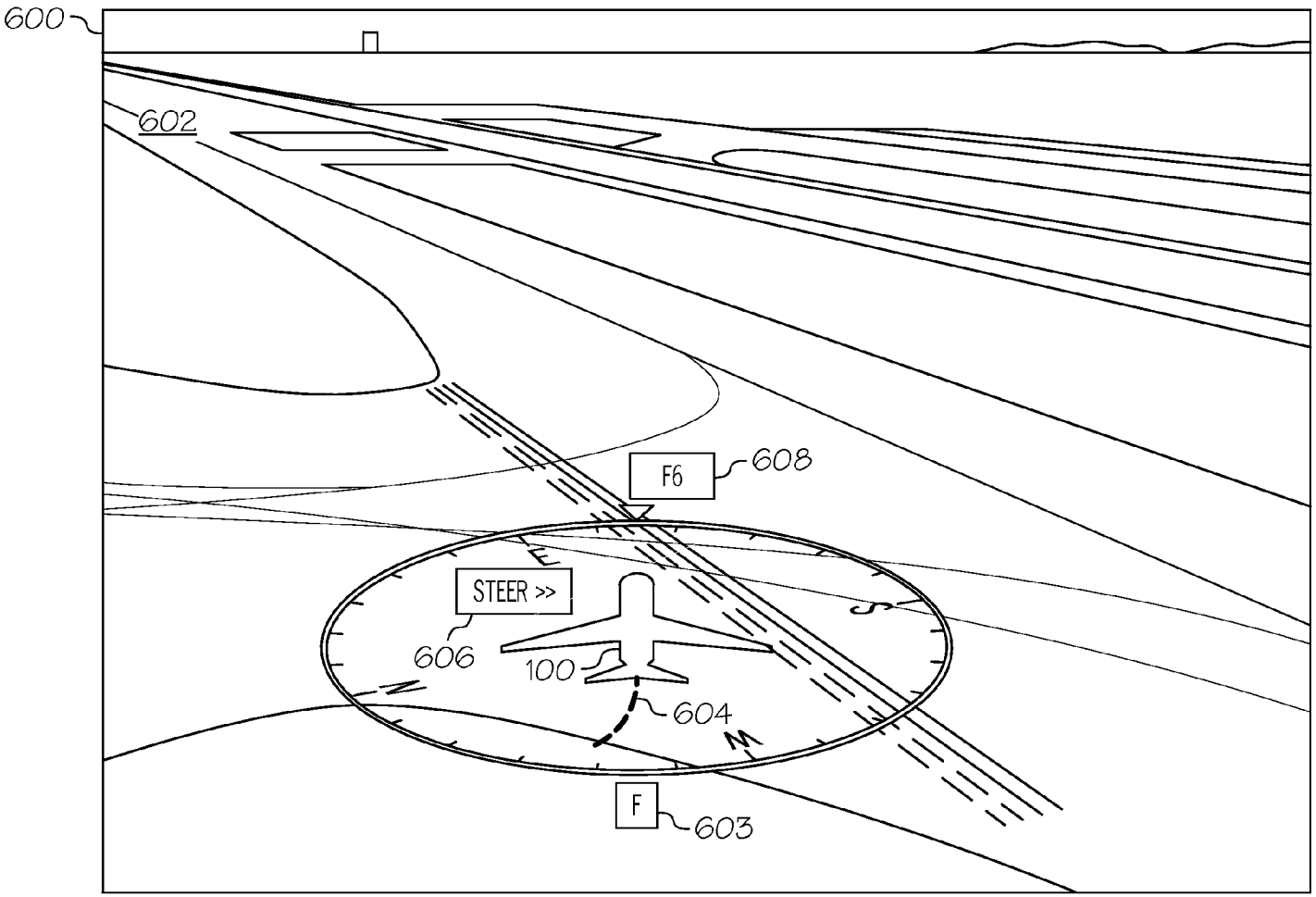
FIG. 6 is a graphical representation of a synthetic vision system display having rendered thereon an airport field, a predicted excursion in a reverse operation, and corrective action.

FIG. 6 is a display 600 having rendered thereon a synthetic vision system map of an airport field 602 and aircraft 100. The display 600 includes a graphical representation of a taxi path 603, which corresponds to the taxiway on which the host aircraft 100 is currently traveling in a ground operation. Graphical representations of various other features, structures, fixtures, and/or elements associated with the airport field 602 are included in display 600; such as other taxiways 608, conformally rendered in accordance with their real-world counterpart taxiways. Display 600 also includes a trend line 604 depicting the predicted aircraft taxi path. Symbology indicative of corrective action to be taken is shown at 606.

FIG. 6 depicts a moment in time when the aircraft 100 is being driven by the electric taxi system, and trend line 604 shows the predicted aircraft path. In display 600, trend line 604 indicates a predicted excursion, in which aircraft 100 travels in a reverse operation, away from the centerline of the taxi path, in reverse and to the left, crosses onto the shoulder within an unsafe distance, and continues to travel off taxi path 503 to the left. The guidance and display system may generate an audible alert in response to the predicted excursion. In response to the predicted excursion, the guidance and display system graphically displays an alert. The graphical display of the alert may comprise one or more symbolic representations, such as: the trend line 604 rendered in a visually distinguishable or highlighted manner that is easy to detect and recognize; text and symbols 606 conveying corrective action to avert the excursion, rendered in a visually distinguishable or highlighted manner; etc.

Figure 7:
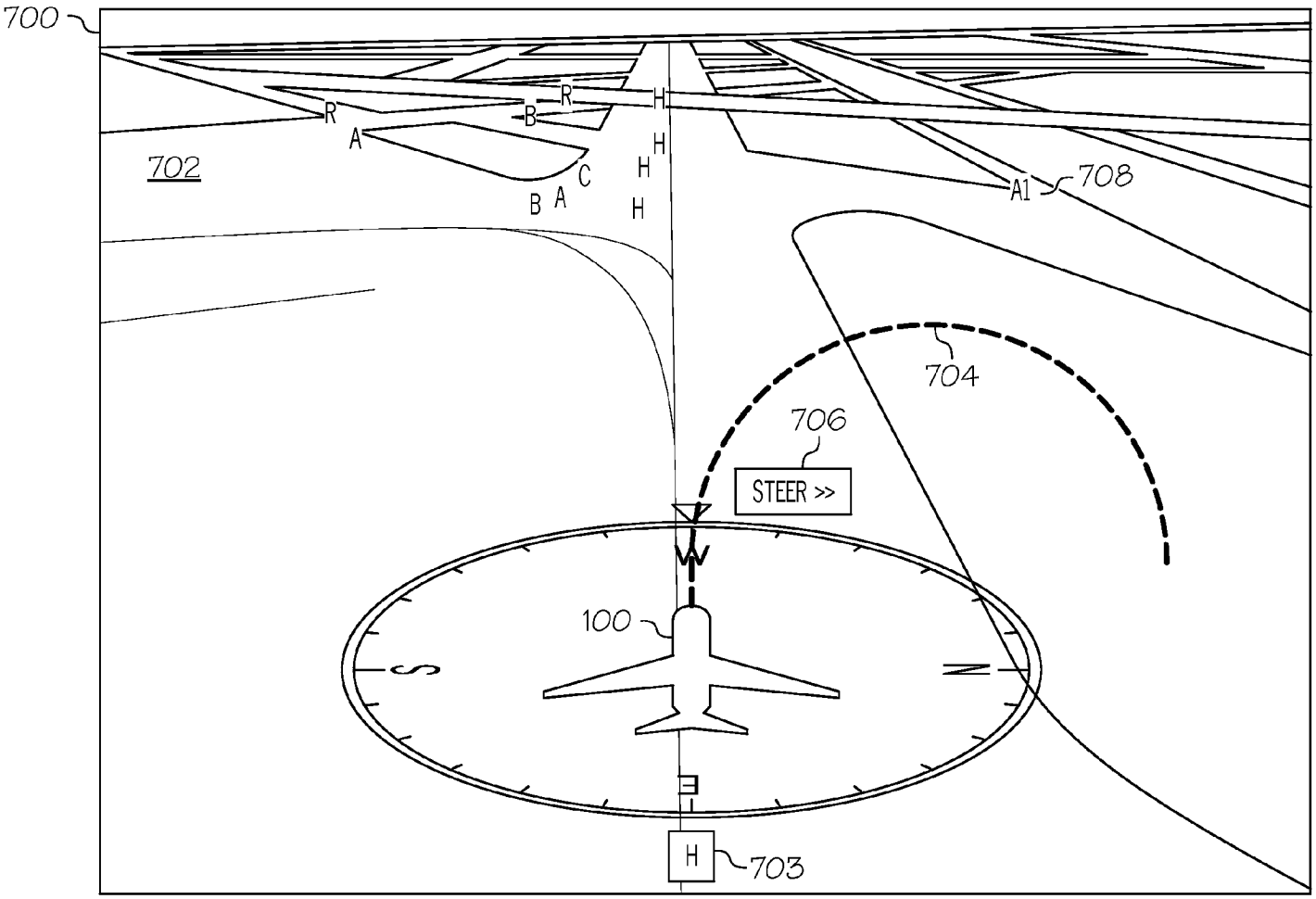
FIG. 7 is a graphical representation of a synthetic vision system display having rendered thereon an airport field, a predicted excursion in a turn operation, where corrective action is to increase steering during the turn.

FIG. 7 is a graphical representation of a display 500 having rendered thereon a synthetic vision system map of an airport field 702 and aircraft 100. The display 700 includes a graphical representation of a taxi path 703, which corresponds to the taxiway on which the host aircraft 100 is currently traveling in a ground operation. Graphical representations of various other features, structures, fixtures, and/or elements associated with the airport field 702 are included in display 700; such as other taxiways 708, conformally rendered in accordance with their real-world counterpart taxiways. Display 700 also includes a trend line 704 depicting the predicted aircraft taxi path. Symbology indicative of corrective action to be taken is shown at 706.

FIG. 7 depicts a moment in time when the aircraft 100 is being driven by the electric taxi system, and trend line 704 shows the predicted aircraft path. In display 700, trend line 704 indicates a predicted excursion, in which aircraft 100, making a right turn, travels away from the centerline of the taxi path to the right, crosses onto the shoulder within an unsafe distance, and continues to travel off of taxi path 703 to the right. In the scenario of FIG. 7, the aircraft steering setting is not at the maximum; consequently, the corrective action is additional turning. The guidance and display system may generate an audible alert in response to the predicted excursion. In response to the predicted excursion, the guidance and display system graphically displays an alert. The graphical display of the alert may comprise one or more symbolic representations, such as: the trend line 704 rendered in a visually distinguishable or highlighted manner that is easy to detect and recognize; text and symbols 706 conveying corrective action to avert the excursion, rendered in a visually distinguishable or highlighted manner; etc.

Figure 8:
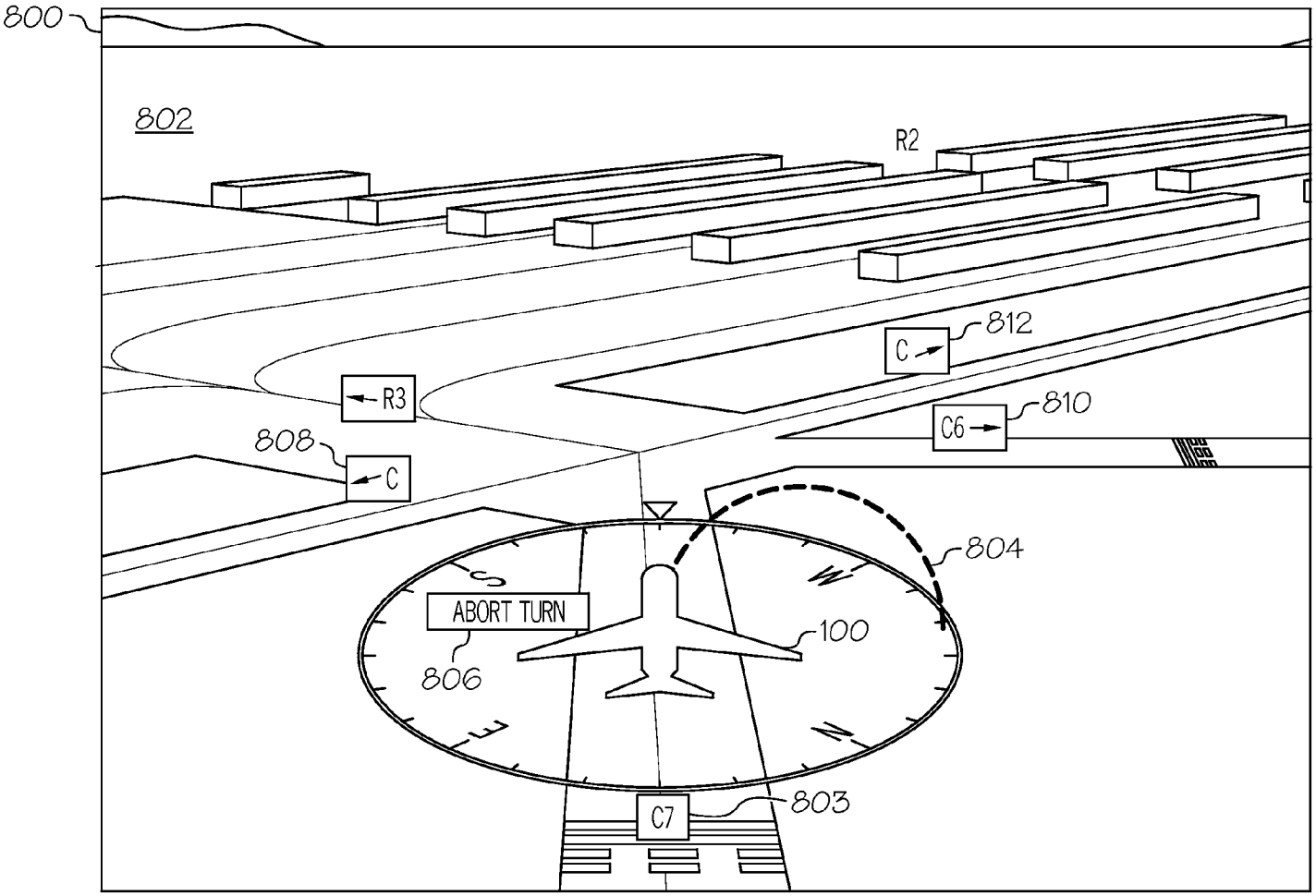
FIG. 8 is a graphical representation of a synthetic vision system display having rendered thereon an airport field, a predicted excursion in a tight turn operation, where corrective action is to abort the turn.

FIG. 8 is a graphical representation of a display 800 having rendered thereon a synthetic vision system map of an airport field 802 and aircraft 100. The display 800 includes a graphical representation of a taxi path 803, which corresponds to the taxiway on which the host aircraft 100 is currently traveling in a ground operation. Graphical representations of various other features, structures, fixtures, and/or elements associated with the airport field 802 are included in display 800; such as other taxiways 808, 810, 812, conformally rendered in accordance with their real-world counterpart taxiways. Display 800 also includes a trend line 804 depicting the predicted aircraft taxi path. Symbology indicative of corrective action to be taken is shown at 806.

FIG. 8 depicts a moment in time when the aircraft 100 is being driven by the electric taxi system, and trend line 804 shows the predicted aircraft path. In display 800, trend line 804 indicates a predicted excursion, in which aircraft 100, making a tight right turn, travels away from the centerline of the taxi path to the right, crosses onto the shoulder within an unsafe distance, and continues to travel off of taxi path 803 to the right. In the scenario of FIG. 8, the aircraft steering setting is already at maximum; consequently, the corrective action is to abort the turn. The guidance and display system may generate an audible alert in response to the predicted excursion. In response to the predicted excursion, the guidance and display system graphically displays an alert. The graphical display of the alert may comprise one or more symbolic representations, such as: the trend line 804 rendered in a visually distinguishable or highlighted manner that is easy to detect and recognize; text and symbols 806 conveying corrective action to avert the excursion, rendered in a visually distinguishable or highlighted manner; etc.

Thus, there has been provided an aircraft taxi path guidance and display system that graphically displays an alert and corrective action when a deviation from the airport active surface area is predicted.

While at least one exemplary embodiment has been presented in the foregoing detailed description, it should be appreciated that a vast number of variations exist. For example, the techniques and methodologies presented here could also be deployed as part of a fully automated guidance and display system to allow the flight crew to monitor and visualize the execution of automated maneuvers. It should also be appreciated that the exemplary embodiment or embodiments described herein are not intended to limit the scope, applicability, or configuration of the claimed subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

What is claimed is:

1. A method for displaying aircraft taxi path guidance on a display unit in an aircraft, the method comprising:

obtaining aircraft status data comprising heading data, steering angle and differential speed of the main landing gear;

obtaining airport feature data;

processing, by a processor, the aircraft status data and the airport feature data to (i) generate a trend line that represents an aircraft predicted taxi path, and (ii) wherein a surface area within the airport in which the aircraft may safely travel comprises an airport active surface area, predict an excursion when an intersection of the aircraft predicted taxi path with a shoulder of an airport active surface area occurs within a predetermined distance threshold;

in response to predicting the excursion, generating, corrective action associated with the excursion, wherein the corrective action is based on the differential speed of the main landing gear; and displaying, on the display unit, symbology that is graphically representative of (i) the trend line, and (ii) the corrective action.

2. A method according to claim 1, further comprising monitoring the trend line with respect to a centerline of the airport active surface area.

3. A method according to claim 1, wherein the predetermined distance threshold is based on: airport active surface area dimensions, aircraft speed, aircraft weight, and aircraft center of gravity.

4. A method according to claim 1, further comprising determining a maximum steering setting of the aircraft.

5. A method according to claim 1, wherein the step of displaying further comprises:

rendering at least one textual warning associated with the excursion.

6. A method according to claim 5, wherein the at least one textual warning comprises at least one of: a steering command, a speed command, a breaking command, and an abort command.

7. A method according to claim 1, wherein the step of generating includes emitting an audible alert.

8. A method according to claim 1, wherein aircraft status data comprises at least one of: aircraft length, aircraft wing width, aircraft turning radius, aircraft speed, aircraft present position, aircraft steering angle, differential speed of main landing gear, and aircraft heading.

9. A method according to claim 1, wherein the step of generating is based on at least one of: width of active surface area, aircraft length, aircraft wing width, aircraft turning radius, and aircraft speed.

10. A method according to claim 1, wherein displaying the trend line further comprises rendering the trend line in a visually distinguishable or highlighted manner when an intersection of the aircraft predicted taxi path with a shoulder of an airport active surface area is predicted by the processor to occur within a predetermined distance threshold.

11. A method for displaying aircraft taxi path guidance for an aircraft, the method comprising:

obtaining aircraft status data comprising heading data, steering angle and differential speed of main landing gear;

obtaining airport feature data;

determining, based on at least the aircraft status data and airport feature data, a trend line that represents an aircraft predicted taxi path of the aircraft;

wherein a surface area within the airport in which the aircraft may safely travel comprises an airport active surface area, determining if the aircraft predicted taxi path enters a shoulder of an airport active surface area within a predetermined distance threshold;

generating corrective action associated with an excursion when it is determined that the aircraft predicted taxi path enters the shoulder of the airport active surface area within the predetermined distance threshold, wherein the corrective action is based on the differential speed of the main landing gear; and displaying, on a display unit, symbology that is graphically representative of the corrective action and symbology graphically representative of the aircraft predicted taxi path.

12. A method according to claim 11, wherein the predetermined distance threshold is based on at least one of: active surface area dimensions, aircraft speed, aircraft weight and aircraft center of gravity.

13. A method according to claim 11, wherein the step of generating further comprises determining a maximum steering setting of the aircraft.

14. A method according to claim 11, wherein the aircraft predicted taxi path is a displayed in a visually distinguishable color when it is determined that the aircraft predicted taxi path enters a shoulder of the airport active surface area within a predetermined distance threshold.

15. A system for displaying aircraft taxi path guidance and display, the system comprising:

a first source of aircraft status data comprising heading data, steering angle and differential speed of main landing gear;

a second source of airport feature data;

a display unit; and a processor operationally coupled to the first source, the second source, and the display unit, the processor configured to:

(a) receive the aircraft status data;

(b) receive the airport feature data;

(c) define a surface area within the airport in which the aircraft may safely travel as an airport active surface area;

(d) determine, in response to at least the aircraft status data and airport feature data, an aircraft position with respect to an active surface area;

(e) generate, in response to at least the aircraft status data and airport feature data, a trend line that represents an aircraft predicted taxi path; and (f) predict an excursion when an intersection of the aircraft predicted taxi path with a shoulder of the airport active surface area occurs within a predetermined distance threshold; and, when an excursion is predicted, (i) generate corrective action associated with the excursion, wherein the corrective action is based on the differential speed of the main landing gear, (ii) generate symbology on the display unit that is graphically representative of the corrective action and graphically representative of the trend line, and (iii) generate an audible alert.

16. A system according to claim 15, wherein the processor is further configured to determine a maximum steering setting of the aircraft.

* * * * *